US007631468B2

(12) United States Patent
Gong et al.

(10) Patent No.: US 7,631,468 B2
(45) Date of Patent: Dec. 15, 2009

(54) SEAM PLATE, FOR RETAINING ROOF DECKING MEMBRANES, HAVING MEANS FOR PREVENTING INTERLOCKING OF ADJACENT PLATES

(75) Inventors: Yongping Gong, Glenview, IL (US); Geroge G. Dewey, Palatine, IL (US); Cheryl L. Panasik, Elburn, IL (US); Eric P. Ziemba, Batavia, IL (US)

(73) Assignee: OMG Roofing, Inc., Agawam, MA (US)

( * ) Notice: Subject to any disclaimer, the term of this patent is extended or adjusted under 35 U.S.C. 154(b) by 771 days.

(21) Appl. No.: 11/064,024

(22) Filed: Feb. 23, 2005

(65) Prior Publication Data

US 2006/0185289 A1 Aug. 24, 2006

(51) Int. Cl.
*E04B 5/00* (2006.01)

(52) U.S. Cl. ..... 52/410; 411/162

(58) Field of Classification Search ..... 52/410, 52/712, 506.05, 512, 408; 411/466, 545, 411/160, 162, 531; 248/248; 428/579; 72/379.2, 72/379.6; 29/557
See application file for complete search history.

(56) References Cited

U.S. PATENT DOCUMENTS

| | | | | |
|---|---|---|---|---|
| 1,435,134 | A | | 11/1922 | Boley |
| 2,334,406 | A | | 11/1943 | Gray |
| 3,427,014 | A | * | 2/1969 | De Bruin ..... 267/1.5 |
| 4,112,693 | A | * | 9/1978 | Collin et al. ..... 405/302.1 |
| 4,139,094 | A | * | 2/1979 | Berry et al. ..... 206/158 |
| 4,361,997 | A | | 12/1982 | Decaro |
| 4,380,413 | A | | 4/1983 | Dewey |
| 4,455,804 | A | | 6/1984 | Francovitch |
| 4,467,581 | A | | 8/1984 | Francovitch |
| 4,476,660 | A | | 10/1984 | Francovitch |
| 4,520,606 | A | | 6/1985 | Francovitch |
| 4,630,422 | A | | 12/1986 | Beneze |
| 4,630,984 | A | | 12/1986 | Reinwall et al. |
| 4,641,472 | A | | 2/1987 | Young |
| 4,726,164 | A | | 2/1988 | Reinwall et al. |
| 4,744,187 | A | | 5/1988 | Tripp |
| 4,763,456 | A | | 8/1988 | Giannuzzi |
| 4,787,188 | A | | 11/1988 | Murphy |
| 4,803,823 | A | | 2/1989 | Stenson |
| 4,900,208 | A | | 2/1990 | Kaiser et al. |
| 4,945,699 | A | | 8/1990 | Murphy |
| 4,987,714 | A | | 1/1991 | Lemke |
| 5,069,589 | A | | 12/1991 | Lemke |
| 5,102,275 | A | | 4/1992 | Hulsey |
| 5,217,339 | A | | 6/1993 | O'Connor et al. |

(Continued)

*Primary Examiner*—Robert J Canfield
*Assistant Examiner*—Brent W Herring
(74) *Attorney, Agent, or Firm*—Alix, Yale & Ristas, LLP

(57) ABSTRACT

A new and improved seam plate, for use in connection with securing roofing membranes to underlying roofing decking substructures, comprises a circular disk having a central aperture for receiving a screw fastener, a plurality of concentric ribs for providing reinforcing and bending or flexibility characteristics to the seam plate, and a plurality of circumferentially spaced, downwardly extending projections or eyehooks. Structure is provided upon the seam plate such that the downwardly extending projections or eyehooks, disposed upon, for example, a first one of a plurality of stacked or nested seam plates, are prevented from entering and becoming interlocked with openings or apertures defined within a second one of the plurality of stacked or nested seam plates.

21 Claims, 8 Drawing Sheets

U.S. PATENT DOCUMENTS 5,255,485 A 10/1993 Lemke
5,267,423 A 12/1993 Giannuzzi
5,378,102 A 1/1995 Mossman
5,709,059 A 1/1998 Murphy et al.
5,803,693 A 9/1998 Chointere et al.
5,915,903 A 6/1999 Osterle et al.
6,044,557 A * 4/2000 Smith et al. ..... 29/897.2
6,205,730 B1 3/2001 Hasan et al.
6,250,034 B1 6/2001 Hulsey
6,640,511 B1 * 11/2003 Link ..... 52/410
6,665,991 B2 12/2003 Hasan
7,381,028 B2 * 6/2008 Hancock et al. ..... 415/214.1

* cited by examiner

SEAM PLATE, FOR RETAINING ROOF DECKING MEMBRANES, HAVING MEANS FOR PREVENTING INTERLOCKING OF ADJACENT PLATES

FIELD OF THE INVENTION

The present invention relates generally to seam plates for use in connection with the retention of roof decking membranes upon roof decking substructures at seam locations defined between separate, adjacent, and overlapping roof decking membranes, and more particularly to a new and improved seam plate, and a roof decking system employing the same, wherein retention of the roof decking membranes upon the roof decking substructure is able to be achieved by means of new and improved eyehook structure which not only effectively prevents the generation or initiation of tearing or other similar deterioration of the roof decking membranes when the roof decking membranes are subjected to wind or other environmental forces, but, in addition, such improved eyehook structure also prevents the undesired interlocking of nested seam plates, as defined between the eyehook structures of nested seam plates, during manufacture, assembly, packaging, and seam plate dispensing. In this manner, the removal of the seam plates from the packaging by operator personnel is not unduly inhibited, and still further, jamming of, for example, assembly and installation dispensing machines is likewise effectively prevented.

BACKGROUND OF THE INVENTION

Stress plates or seam plates are used in connection with the retention of roof decking membranes upon roof decking substructures at seam locations defined between separate but adjacent or overlapping roof decking membranes, and are of course well-known in the art. Examples of such seam plates or stress plates are disclosed within U.S. Pat. No. 4,945,699 which issued to Murphy on Aug. 7, 1990, as well as U.S. Pat. No. 4,787,188 which also issued to Murphy on Nov. 29, 1988. As can be appreciated from FIGS. 1,2, and 3A-3C of the drawings, which substantially correspond to FIGS. 4,1, and 3A-3C, respectively, of the aforenoted U.S. Pat. No. 4,945,699 to Murphy, the roof decking substructure is disclosed at 103 and may conventionally be provided with overlying insulation 102.

The insulation 102 is, in turn, adapted to have roof decking membranes disposed thereon in an overlying manner, and at a location or site at which separate and adjacent roof decking membranes are to be in effect seamed together in an overlapping manner, a first underlying roof decking membrane is disclosed at 101 and is adapted to be secured to the underlying deck substructure 103 by means of a screw fastener 107 passing through a seam plate or stress plate 10, while a second roof decking membrane 104 is adapted to be secured in an overlapping manner upon the first underlying roof decking membrane 101 by means of a welded seam 111. The seam plate or stress plate 10 is seen to have a circular configuration, and is provided with an upper surface 11 and a lower surface 12. A central aperture 15 is provided for passage therethrough of the screw fastener 107, and a circular reinforcing rib 14 annularly surrounds the central aperture 15.

Accordingly, when such a stress plate or seam plate 10 is to be used to secure roof decking membranes to the underlying decking substructure 103, the stress plate or seam plate 10 is disposed atop the first underlying roof decking membrane 101, and the stress plate or seam plate 10 is then fixedly secured to the underlying decking substructure by means of screw fastener 107 being threadedly engaged with the underlying decking substructure. In accordance with the particularly unique stress plate or seam plate 10 as disclosed within the noted Murphy patents, the bottom surface 12 of the stress plate or seam plate 10 is provided with a plurality of circumferentially spaced prongs or tangs 21 each of which terminates in a gripping point 22. The prongs or tangs 21 each have a substantially triangular configuration and are in effect partially punched-out or otherwise cut from the bottom surface portion 12 of the plate 10, and are subsequently bent such that the prongs or tangs 21 attain their desired disposition with respect to the bottom surface portion 12 of the plate 10. Such prongs or tangs 21 will therefore grip the lower or underlying roof decking membrane 101 and prevent the same from becoming loose or free with respect to the stress plate 10 or the underlying roof substructure 103 despite wind or other environmental forces being impressed upon the roof decking membrane 101.

While the aforenoted stress or seam plates of Murphy have been satisfactory and commercially successful, it has been experienced that, despite well-meaning statements of intent to the contrary as set forth in the Murphy patents, the presence of the pointed prongs or tangs 21 characteristic of the stress plate or seam plate 10 of Murphy do in fact tend to puncture, tear, weaken, and otherwise cause deterioration of the roof decking membranes 101 under wind and other environmental conditions. Obviously, such a state is not satisfactory in view of the fact that eventually, the roof decking membranes tear away from the overlying seam plate 10 as well as away from the underlying roof decking, with the consequent result being the compromise of the structural integrity of the entire roof decking system. Accordingly, the stress or seam plate, as disclosed within U.S. Pat. No. 6,665,991 which issued to Hasan on Dec. 23, 2003, was developed in order to effectively rectify the deficiencies characteristic of the stress or seam plate as disclosed within the aforenoted patent to Murphy. More particularly, as disclosed within FIGS. 4 and 5, wherein FIG. 4 discloses a stress or seam plate 210 generally similar to the stress or seam plate disclosed in FIG. 4 of the Hasan patent, and wherein further, FIG. 5 corresponds to FIG. 7 of the Hasan patent, it is seen that each one of the projections 232 is effectively struck or punched out from the plate 210 so as to comprise side or leg portions 234,236 and a rounded apex portion 238. While the stress or seam plate 210 has been commercially successful and has provided improved service and wear attributes in connection with roof decking structures, as a result of the particular configuration of the projections 232 having effectively resolved the undesirable tearing or puncturing problems encountered or caused by means of the pointed barbs, prongs, or tangs 21 of Murphy, some operational difficulties have occasionally been experienced with the stress or seam plate 210 of Hasan.

For example, as can readily be appreciated from FIGS. 4 and 5, in view of the fact that, as has been noted, each one of the projections 232 has been struck or punched out from the stress or seam plate 210 so as to project downwardly beneath the undersurface portion 250 of the stress or seam plate 210, as defined by means of the side or leg portions 234,236 and the rounded apex portion 238, a substantially rectangularly configured through-aperture 252 is defined within those regions of the stress or seam plate 210 from which the projections 232 have been struck or punched. Accordingly, when a plurality of the stress or seam plates 210 are disposed in contact with each other, such as, for example, in a nested state within packaging, or in a nested state within an installation tool, it is possible that one or more of the stress or seam plates 210 can become interlocked together as a result of the downwardly extending projections 232 disposed upon one of the stress or seam plates 210 being aligned with and entering a corresponding aperture 252 formed within an adjacent stress or seam plate 210. Therefore, when the seam or stress plates 210 are to be removed from the packaging so as to, for example, be deposited within a suitable magazine of an installation tool, the adjacent seam or stress plates 210, which have effectively become stuck together as a result of the aforenoted disposition of one or more of the downwardly extending projections 232 of one of the stress or seam plates 210 having become jammed within a corresponding aperture 252 formed within the adjacent one of the stress or seam plates 210, are difficult to separate. In a similar manner, when the stress or seam plates 210, disposed within the installation tool are to be individually and serially dispensed from the installation tool in connection with the installation of environmental membranes upon a roof decking substructure, the adjacent stress or seam plates 210 which have effectively become stuck together, as a result of the aforenoted disposition of one more of the downwardly extending projections 232 of one of the stress or seam plates 210 having become jammed within a corresponding aperture 252 formed within the adjacent one of the stress or seam plates 210, will not be readily able to be separated and dispensed whereby the installation tool will experience jamming. All of these difficulties will, of course, lead to operational or production downtime whereby personnel will have to expend a substantial amount of time separating the stress or seam plates 210 which have become interlocked together with respect to each other either within the packaging or installation tool, leading to operational or production inefficiencies.

A need therefore exists in the art for a new and improved stress plate or seam plate wherein the stress plate or seam plate can satisfactorily engage the environmental membranes so as to secure the environmental membranes to the underlying roof decking substructure, and yet, the means formed upon the stress plate or seam plate for engaging the environmental membranes will not tend to initiate tearing of the environmental membranes under, for example, windy or other forceful environmental conditions, and still yet further, such stress plates or seam plates will not become interlocked with respect to each other despite the fact that they will be disposed within a nested state.

SUMMARY OF THE INVENTION

The foregoing and other objectives are achieved in accordance with the teachings and principles of the present invention through the provision of a new and improved stress plate or seam plate which comprises a circular structure having a central aperture for receiving a screw fastener. A downwardly projecting annular rib surrounds the central aperture for reinforcing the same, and a plurality of concentric ribs are defined between the central aperture and the peripheral edge of the plate for providing reinforcing and bending or flexibility characteristics to the stress plate or seam plate. In addition, a plurality of circumferentially spaced, downwardly extending projections or eyehooks are provided upon the underside of the seam or stress plate, wherein the projections or eyehooks have substantially V-shaped cross-sectional configurations, with substantially rounded or radiused apices, so as not to puncture or rupture the roof decking membranes, and yet, such projections or eyehooks can satisfactorily engage the roof decking membranes so as to fixedly retain the same upon the underlying roofing decking substructure. Still yet further, in accordance with the principles and teachings of the present invention, the new and improved projections or eyehook structures also prevent the undesired interlocking of nested stress or seam plates, as defined between the projections or eyehook structures of the nested seam plates, during manufacture, assembly, packaging, and seam plate dispensing. In this manner, the removal of the seam plates from the packaging by operator personnel is not unduly inhibited, and still further, jamming of, for example, the assembly and installation dispensing apparatus is likewise effectively prevented.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 6:
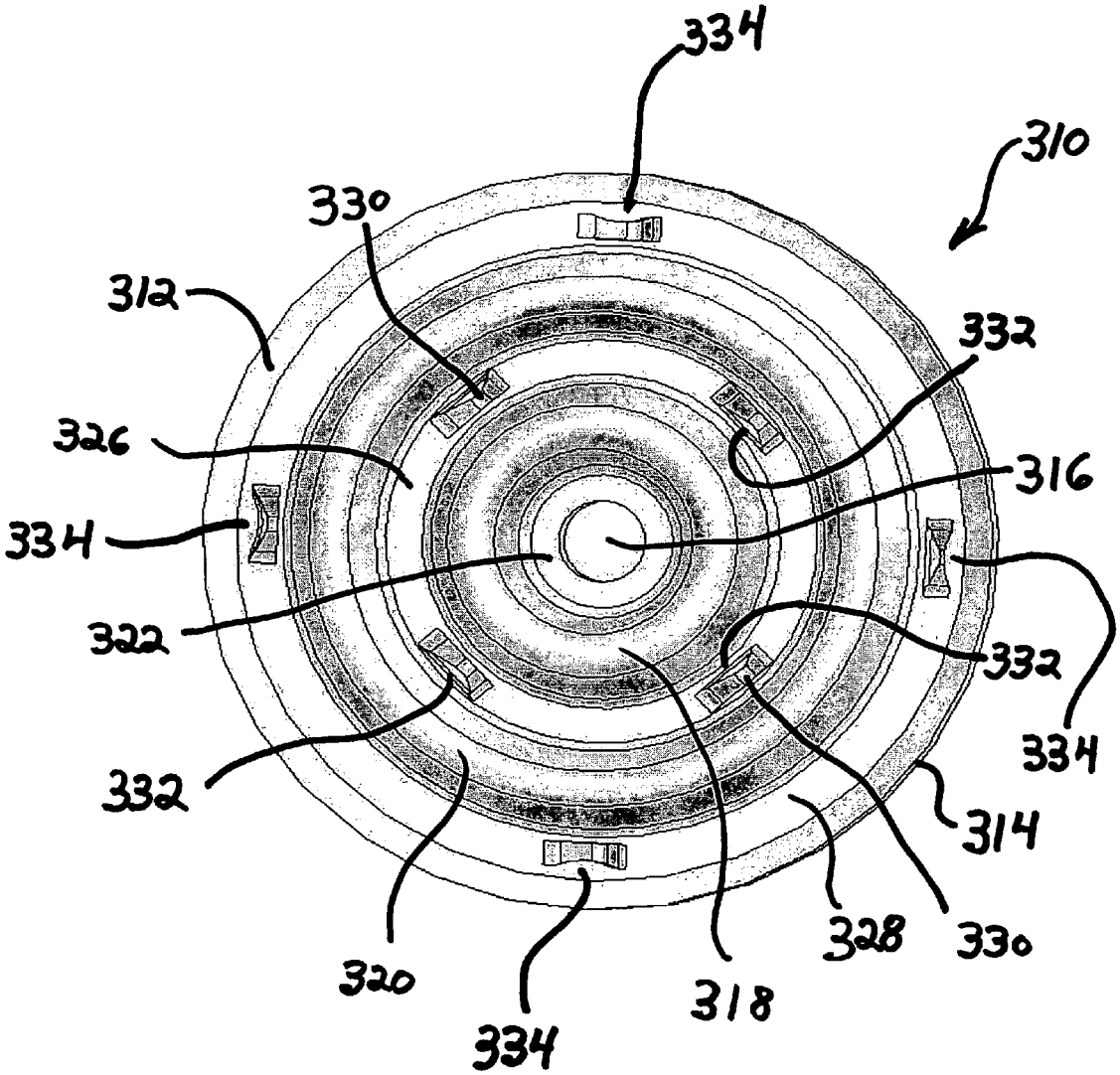
FIG. 6 is a top plan view, similar to that of FIG. 4, showing a first embodiment of a new and improved stress or seam plate, constructed in accordance with the principles and teachings of the present invention, illustrating, in particular, the formation of a deformed region, fabricated by means of a suitable coining or swaging operation, adjacent to each one of the rectangular apertures from which each one of the downwardly extending projections or eyehooks has been formed, so as to effectively prevent the undesirable interlocking of the downwardly extending projections or eyehooks of one stress or seam plate within the rectangular aperture of an adjacent stress or seam plate when a plurality of stress or seam plates are disposed within a stacked array.
Figure 7:
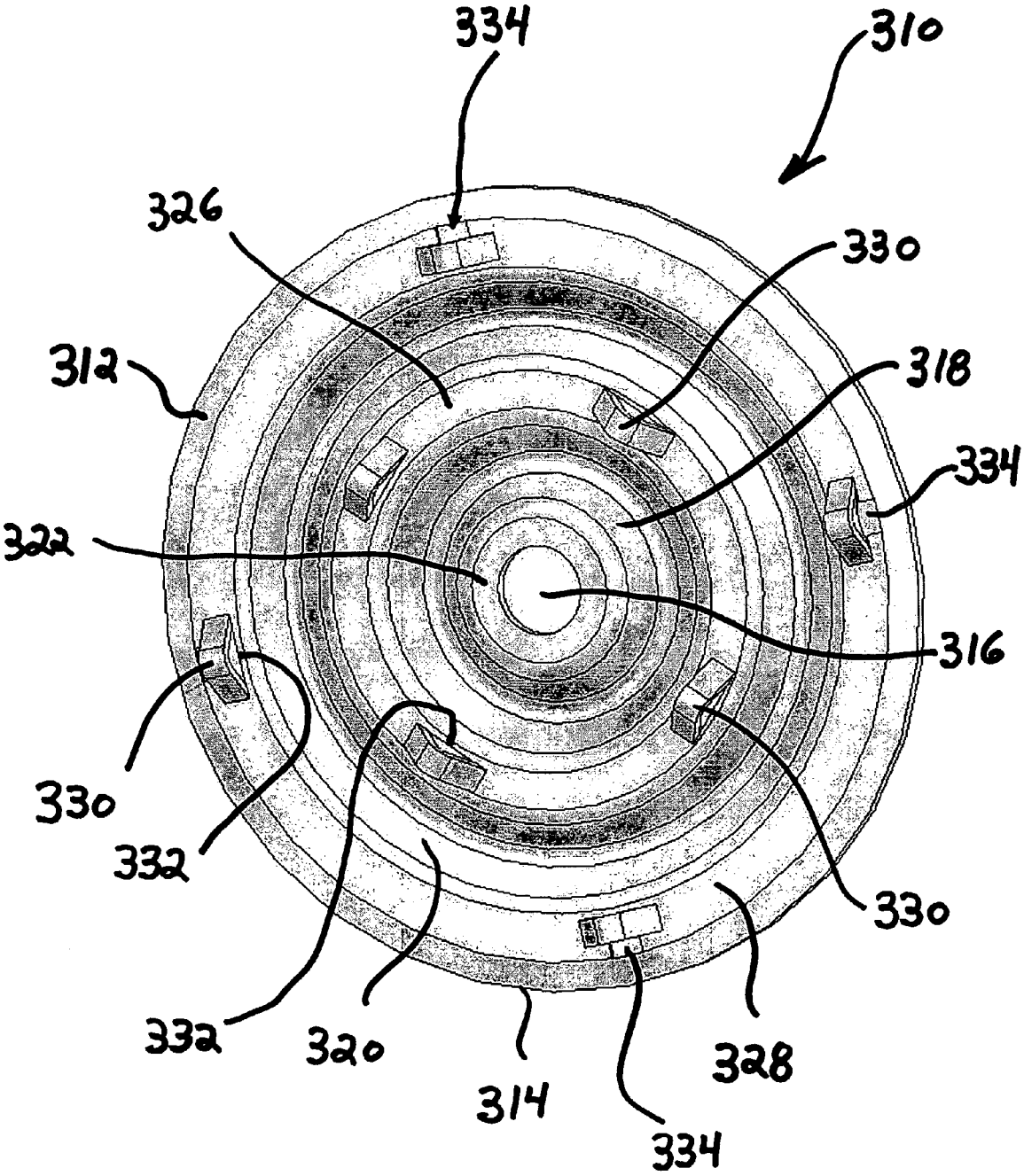
FIG. 7 is a bottom plan view of the stress or seam plate illustrated within FIG. 6.

Referring now to the drawings, and more particularly to FIGS. 6 and 7 thereof, a first embodiment of a new and improved stress or seam plate, constructed in accordance with the principles and teachings of the present invention, illustrating, in particular, the formation of a deformed region, fabricated by means of a suitable coining or swaging operation, adjacent to each one of the rectangular apertures from which each one of the downwardly extending projections or eyehooks has been formed, so as to effectively prevent the undesirable interlocking of the downwardly extending projections or eyehooks of one stress or seam plate within the rectangular aperture of an adjacent stress or seam plate when a plurality of stress or seam plates are disposed within a stacked array, is disclosed and is generally indicated by the reference character 310. More particularly and briefly, it is seen that the stress or seam plate 310 is similar to the stress or seam plate as disclosed within the aforenoted patent to Hasan and is therefore seen to comprise a substantially planar plate or disk 312 which has a circular configuration wherein the diametrical extent of the same is approximately 3.00 inches. The plate or disk 312 has an outer peripheral edge portion 314, and is also provided with a central aperture 316 for receiving therethrough, for example, a threaded fastener, not shown, but which may be similar to the threaded fastener 107 shown in conjunction with the conventional stress plate or seam plate 10 illustrated within FIG. 1, whereby the seam or stress plate 310 may be fixedly secured to an underlying roof decking substructure, also not shown but similar to the roof decking substructure 103 as shown in the conventional roof decking assembly of FIG. 1, in order to in turn fixedly secure roof decking membranes to the underlying roof decking substructure.

Figure 1:
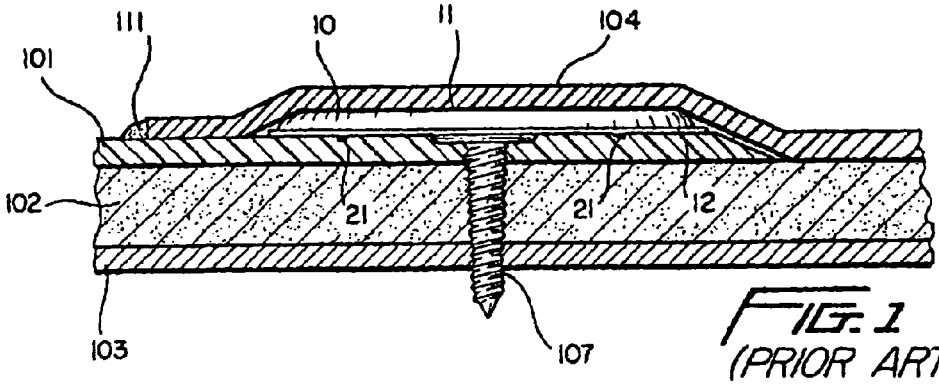
FIG. 1 (PRIOR ART)
FIG. 1 is a cross-sectional view of a PRIOR ART roof decking system or assembly showing the conventional mounting of a stress plate or seam plate at the seamed location of two overlapping roof decking membranes as secured to the underlying roofing decking substructure.
Figure 4:
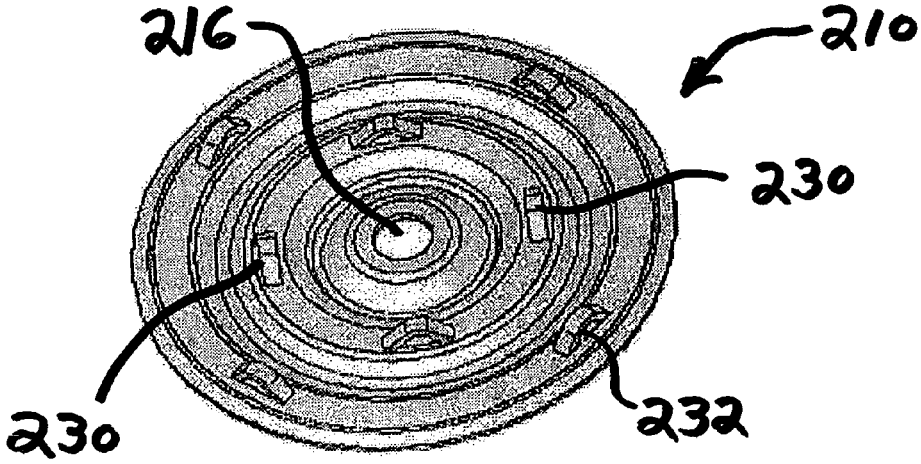
FIGURE 4 (PRIOR ART)
FIG. 4 is a top plan view of a PRIOR ART stress or seam plate having dependent projections or eyehooks that have been structured to overcome the deficiencies of the sharply pointed prongs or tangs of the stress or seam plate shown in FIGS. 3A-3C.
Figure 5:
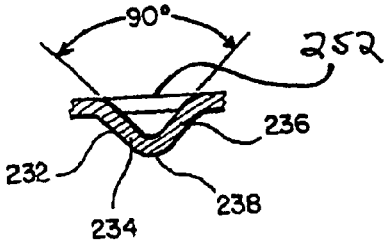
FIG. 5 (PRIOR ART)
FIG. 5 is a cross-sectional view of the PRIOR ART stress or seam plate shown in FIG. 4 illustrating in detail one of the dependent projections or eyehooks having the rounded or radiused apex portion.
Figure 2:
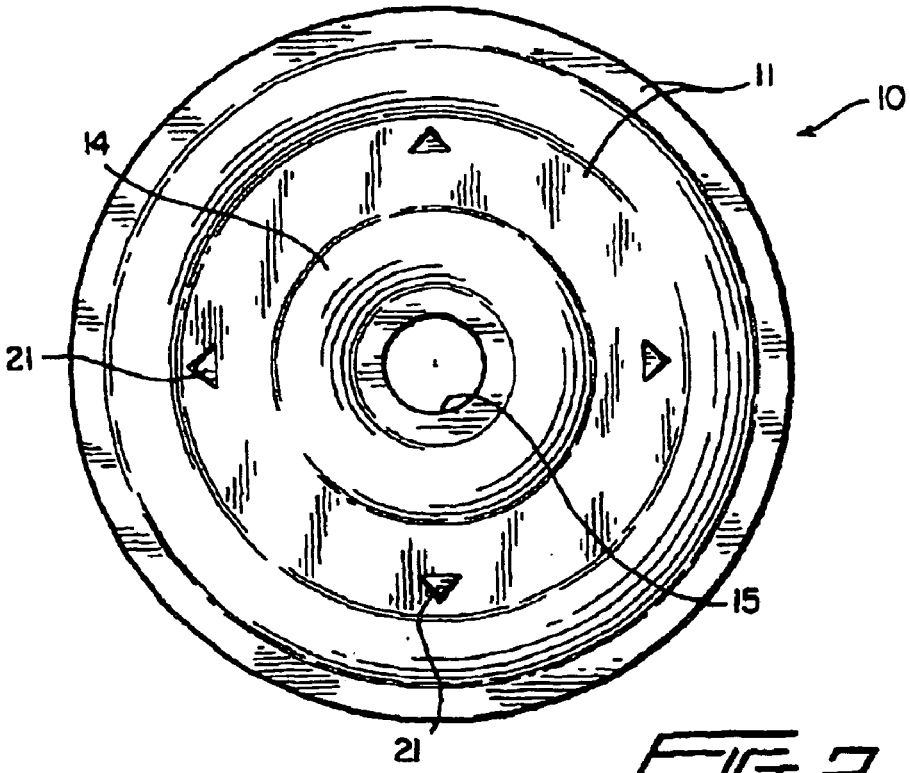
FIG. 2 (PRIOR ART)
FIG. 2 is a top plan view of the PRIOR ART seam plate or stress plate used within the PRIOR ART roof decking system or assembly disclosed within FIG. 1.
Figure 3A:
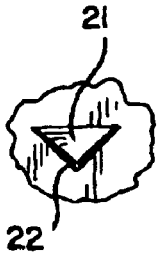
FIG. 3A (PRIOR ART)
FIGS. 3A-3C are top plan, cross-sectional, and bottom plan views of a portion of the PRIOR ART seam plate or stress plate shown in FIG. 2 so as to specifically illustrate the sharply pointed prongs or tangs of the seam plate or stress plate shown in FIG. 2.
Figure 3B:
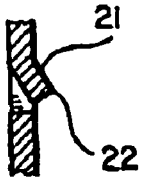
FIG. 3B (PRIOR ART)
Figure 3C:
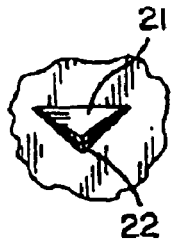
FIG. 3C (PRIOR ART)

Continuing further, the seam plate 310 has a substantially sinusoidal cross-sectional configuration as defined in effect by means of a reinforcing rib system comprising a plurality of concentrically disposed annular rib members which includes a first, radially inner, upwardly extending annular rib member 318 and a second, radially outer, upwardly extending annular rib member 320. In connection with the accommodation or housing of the threaded fastener, not shown, within the central aperture 316, the innermost or centralmost region of the seam plate 310 is seen to further comprise an annular shoulder region 322 upon which the head of the threaded fastener, not shown, can be seated, and in conjunction with the first and second radially inner and radially outer upwardly extending annular rib members 318,320, the seam plate 310 is seen to further comprise, in effect, a first, complementary, radially inner, downwardly extending annular rib member 326, and a second, radially outer, downwardly extending annular rib member 328 wherein it is seen that the first, radially inner, downwardly extending annular rib member 326 is radially interposed between the first and second radially inner and radially outer upwardly extending annular rib members 318, 320, whereas the second, radially outer, downwardly extending annular rib member 328 is radially interposed between the second radially outer upwardly extending annular rib members 320 and the peripheral edge portion 314 of the seam plate 310. In addition, in order to engage the roofing decking membranes, not shown but similar to membrane sheet 101 as seen in FIG. 1, and to retain the same at their desired locations upon the underlying roofing decking assembly, the stress or seam plate 310 of the present invention is provided with downwardly extending projections or eyehooks 330, which are similar to the downwardly extending projections or eyehooks 230,232 as disclosed within the aforenoted patent to Hasan, so as not to readily tear or puncture the roof decking membranes and thereby effectively protect such roof decking membranes against deterioration so as to, in turn, preserve the structural integrity of the same.

With reference continuing to be made to FIGS. 6 and 7, it has been noted that the downwardly extending projections or eyehooks 330 have been formed within the stress or seam plate 310 by means of, for example, a suitable punching process whereby the projections or eyehooks 330 are effectively partially severed from the stress or seam plate 310 along their oppositely disposed longitudinal sides or extents while nevertheless still being integrally connected to the stress or seam plate 310 at their oppositely disposed, longitudinally spaced end portions. Accordingly, as a result of the aforenoted punching operation, a substantially rectangularly configured through-aperture 332 is formed within the stress or seam plate 310 at each one of the sites at which each one of the projections or eyehooks 330 has been formed. As has also been noted hereinbefore, it can therefore be readily appreciated that when a plurality of the stress or seam plates 310 are disposed within a nested or stacked array, one or more of the downwardly extending projections or eyehooks 330 disposed upon one of the stress or seam plates 310 can enter and become lodged or interlocked within a corresponding one or more of the through-apertures 332 defined within an adjacent one of the nested or stacked stress or seam plates 310. In accordance, then, with the particularly unique and novel principles and teachings of the present invention, means have been incorporated into, or provided upon the stress or seam plates 310 for effectively preventing this undesirable interlocking phenomena from occurring.

More particularly, as disclosed within FIGS. 6 and 7, a portion of the stress or seam plate 310 has been coined or swaged within a region disposed immediately radially outwardly of one or more of the rectangularly-configured through-apertures 332, as denoted at 334, from which the projections or eyehooks 330 extend downwardly, so as to effectively alter the geometrical configurations or profiles of the substantially rectangularly-configured through-apertures 332. In particular, the coining or swaging operations causes a rim portion or region 334 of the stress or seam plate 310, disposed immediately adjacent to the one or more of the rectangularly-configured through-apertures 332 to effectively extend over or partially cover the original rectangularly-configured through-aperture 332. In this manner, when a downwardly extending projection or eyehook 330, disposed upon a first one of the stress or seam plates 310, tends or tries to enter a complementary aperture 332, defined within a second one of the stress or seam plates 310 which is disposed adjacent to the first stress or seam plate 310 as when a plurality of the stress or seam plates 310 are disposed within a nested stacked array, the projection or eyehook 330 disposed upon the first one of the stress or seam plates 310 will effectively be prevented from entering, and becoming interlocked with, the aperture 332 defined within the second one of the stress or seam plates 310 because the external profile of the projection or eyehook 330, disposed upon the first one of the stress or seam plates 310, can no longer be physically accommodated within the aperture 332, defined within the second one of the stress or seam plates 310, in view of the fact that the aperture 332 now has an altered geometrical con-figuration or profile as caused by means of the coined or swaged rim region 334.

The aforenoted aperture profile-altering results, achieved by means of the coining or swaging of the noted regions 334 disposed immediately adjacent to the apertures 332, can be further appreciated as a result of reference being made to FIGS. 8A-8D. More particularly, as disclosed within FIG. 8A, a first mode for forming the coined or swaged regions 334 of the stress or seam plate 310, adjacent to each one of the rectangular apertures 332 from which each one of the downwardly extending projections or eyehooks 330 has been formed, resides in the coining or swaging of an undersurface portion of the stress or seam plate disk 312 so as to effectively cause an upper surface portion of the seam or stress plate 312 to extend radially inwardly into, and therefore, partially cover, the aperture 332. The radially inward extent, to which the upper surface portion of the stress or seam plate disk 312 has been coined or swaged, has been designated as $D_3$, while the aperture 332 has an original radial dimension designated $D_1$, and the radial dimension of the downwardly extending projection or eyehook 330 is designated as $D_2$ which is of course substantially equal to the dimension $D_1$ of the aperture 332 in view of the fact that the aperture 332 has of course been defined as a result of the material forming the projection or eyehook 330 has been punched out from the stress or seam plate disk 312.

Figure 8A:
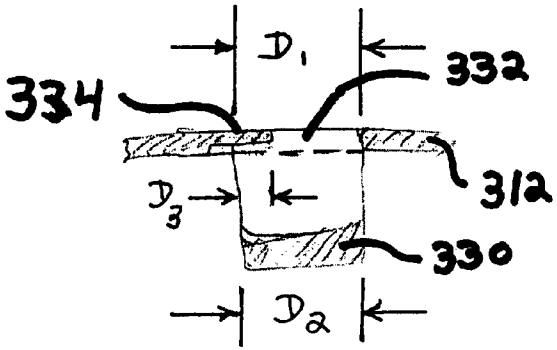
FIG. 8A is a cross-sectional view of a first mode for forming the coined or swaged regions of the stress or seam plate, adjacent to each one of the rectangular apertures from which each one of the downwardly extending projections or eyehooks is formed, as disclosed within FIGS. 6 and 7.
Figure 8B:
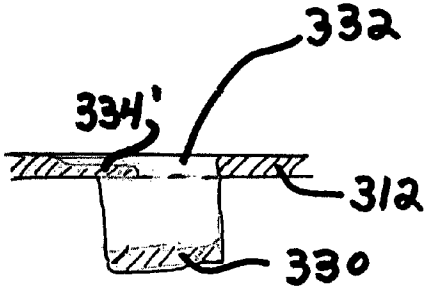
FIG. 8B is a cross-sectional view, similar to that of FIG. 8A, of a second mode for forming the coined or swaged regions of the stress or seam plate, adjacent to each one of the rectangular apertures from which each one of the downwardly extending projections or eyehooks is formed.
Figure 8C:
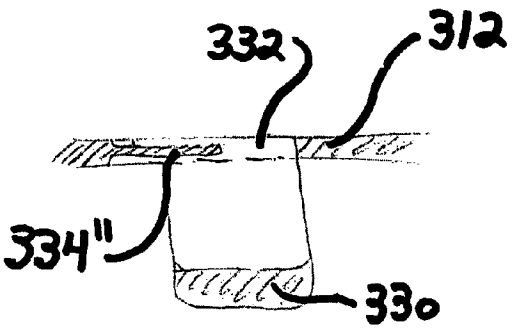
FIG. 8C is a cross-sectional view, similar to those of FIGS. 8A and 8B, of a third mode for forming the coined or swaged regions of the stress or seam plate, adjacent to each one of the rectangular apertures from which each one of the downwardly extending projections or eyehooks is formed.
Figure 8D:
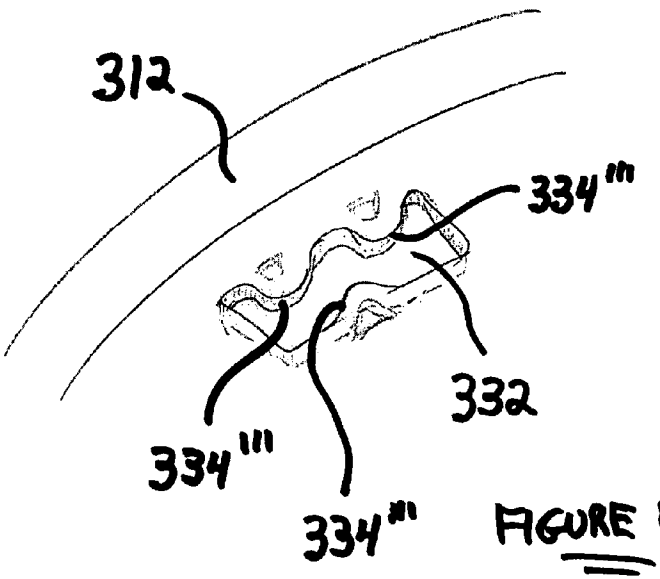
FIG. 8D is a top perspective view of a fourth mode for forming the coined or swaged regions of the stress or seam plate, adjacent to each one of the rectangular apertures from which each one of the downwardly extending projections or eyehooks is formed.

It can therefore be readily appreciated that since the coined or swaged region 334 of the stress or seam plate disk 312 overhangs the aperture 332 so as to partially occlude or obstruct the same, a downwardly extending projection or eyehook 330, disposed upon an adjacent stress or seam plate 310, which may be disposed within a nested or stacked array with respect to the stress or seam plate 310 illustrated within FIG. 8A, cannot enter the aperture 332 formed within the illustrated stress or seam plate 310, and therefore, the undesirable interlocking of the projections or eyehooks 330, disposed upon adjacent stress or seam plates 310, is effectively prevented. In accordance with a second coining or swaging technique or mode, as illustrated within FIG. 8B, the coined or swaged region 334' is formed by coining or swaging an upper surface portion of the stress or seam plate disk 312 so as to effectively cause an undersurface portion of the seam or stress plate 312 to extend radially inwardly into, and therefore, partially cover, the aperture 332. Furthermore, in accordance with a third coining or swaging mode or technique, as illustrated within FIG. 8C, the coined or swaged region 334" is formed by coining or swaging both the upper and undersurface portions of the stress or seam plate disk 312 so as to effectively cause an intermediate surface portion of the seam or stress plate 312 to extend radially inwardly into, and therefore, partially cover, the aperture 332. Lastly, in accordance with a fourth coining or swaging mode or technique, as illustrated within FIG. 8D, portions of the seam or stress plate disk 312, disposed upon both opposite sides of the aperture 332, may be coined or swaged so as to cause oppositely disposed regions 334''' to extend radially inwardly into, and thereby partially cover, occlude, or obstruct, the aperture 332. It is to be noted, as clearly illustrated within FIG. 8D, that the coining or swaging need not be effected along the entire longitudinal edge portions of the rectangularly-configured apertures 332 but only at predetermined longitudinal locations such that the openings or apertures 332 are in fact, partially, yet sufficiently, covered, occluded, or obstructed.

Figure 9:
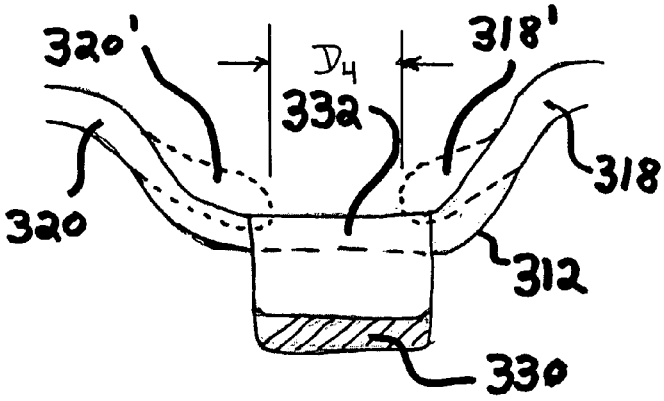
FIG. 9 is a cross-sectional view, similar to those of FIGS. 8A-8C, of a fifth mode for deforming the regions of the stress or seam plate, adjacent to each one of the rectangular apertures from which each one of the downwardly extending projections or eyehooks is formed, so as to effectively prevent the interlocking of nested stress or seam plates.

With reference now being made to FIG. 9, a fifth mode for deforming the rim regions of the stress or seam plate 312, adjacent to each one of the rectangular apertures 332 from which each one of the downwardly extending projections or eyehooks 330 is formed, so as to effectively prevent the interlocking of nested stress or seam plates, is disclosed. More particularly, localized regions of, for example, the first, radially inner, upwardly extending annular rib member 318, and localized regions of, for example, the second, radially outer, upwardly extending annular rib member 320, that are located immediately adjacent to each one of the openings or apertures 332, are deformed or displaced upwardly, and radially outwardly and radially inwardly, respectively, as denoted at 318',320'.

The fact that such deformed or displaced rim regions are located upon, or disposed immediately adjacent to, the inclined rib members 318,320 permits such localized regions to be deformed or displaced without substantially altering the relative disposition, or adversely affecting the orientation, of the downwardly extending projections or eyehooks 330. Accordingly, it can again be readily appreciated that since the transverse or radial dimension $D_4$, defined between the deformed or displaced portions 318',320' of the rib members 318,320, is less than the dimension $D_1$ defined between the oppositely disposed longitudinal edge portions of each opening or aperture 332, a downwardly extending projection or eyehook 330, disposed upon a first stress or seam plate 310 and having a radial dimension $D_2$ which is the same as the dimension $D_1$ of the opening or aperture 332, cannot enter the aperture 332 formed within a second stress or seam plate, as illustrated within FIG. 9, and therefore, the undesirable interlocking of the projections or eyehooks 330, disposed upon adjacent stress or seam plates 310 of a nested stacked array of stress or seam plates, is effectively prevented.

Figure 10A:
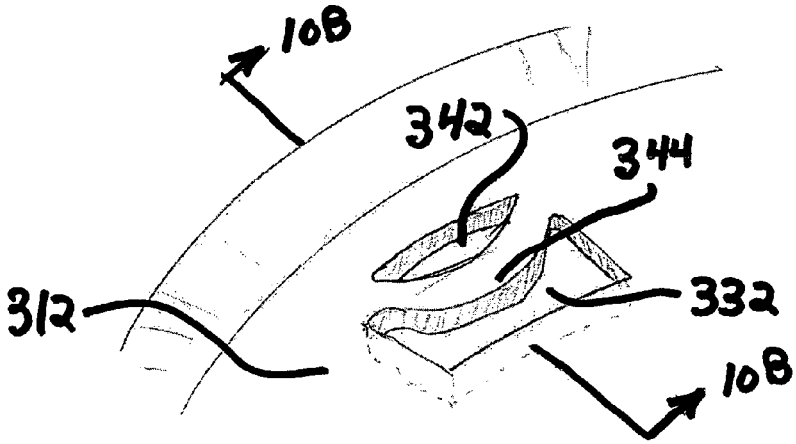
FIG. 10A is a top perspective view, similar to that of FIG. 8D showing, however, a sixth mode for deforming the regions of the stress or seam plate, disposed adjacent to each one of the rectangular apertures from which each one of the downwardly extending projections or eyehooks is formed, by means of a punching operation so as to effectively prevent the interlocking of nested stress or seam plates.
Figure 10B:
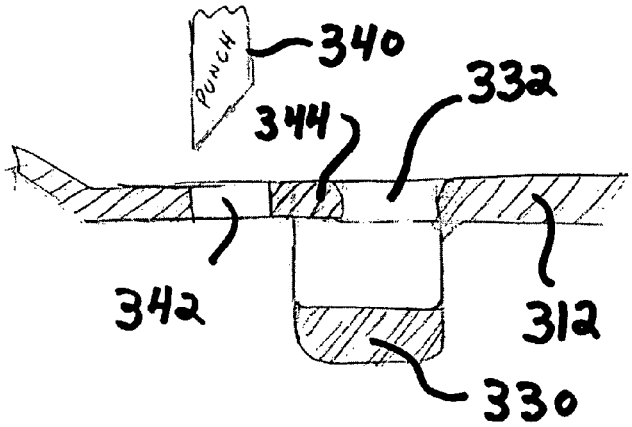
FIG. 10B is a cross-sectional view, similar to those of FIGS. 8A-8C, taken along the lines 10B-10B of FIG. 10A showing the sixth mode for deforming the regions of the stress or seam plate which are disposed adjacent to each one of the rectangular apertures from which each one of the downwardly extending projections or eyehooks is formed.

Considering now FIGS. 10A and 10B, a sixth mode for deforming the regions of the stress or seam plate 312, disposed adjacent to each one of the rectangular apertures 332 from which each one of the downwardly extending projections or eyehooks 330 is formed, so as to effectively prevent the interlocking of nested stress or seam plates, is disclosed and is seen to comprise a punching operation. More particularly, it is seen that a punch mechanism 340 is used to form an auxiliary aperture 342 within the stress or seam plate disk 312 at a location disposed immediately adjacent to the opening or aperture 332 from which each one of the downwardly extending projections or eyehooks 330 has been formed. Unlike the punching operation which formed each one of the downwardly extending projections or eyehooks 330, however, wherein a portion of the stress or seam plate material is partially severed, the punching operation utilizing the punch mechanism 340 in forming the hole or aperture 342 causes a rim portion of the material forming the stress or seam plate disk 312 to be moved radially or transversely as denoted at 344 so as to again form an overhanging member which partially covers, occludes, or obstructs the opening or aperture 332. According, again, a downwardly extending projection or eyehook 330, disposed upon a first stress or seam plate 310, cannot enter the aperture 332 formed within a second stress or seam plate, as illustrated within FIGS. 10A and 10B, and therefore, the undesirable interlocking of the projections or eyehooks 330, disposed upon adjacent seam or stress plates 310 of a nested stacked array of stress or seam plates, is effectively prevented.

As has been appreciated from the various embodiments developed in accordance with the principles and teachings of the present invention, and as illustrated within FIGS. 8A-8D, 9,10A, and 10B, regions of, for example, a first one of the stress or seam plates 310, disposed immediately adjacent to the various apertures or openings 332 defined within such stress or seam plate 310, have been deformed or otherwise worked so as to effectively alter the geometrical configurations or profiles of the apertures or openings 332 defined within such stress or seam plate 310 so as to effectively prevent one or more of the downwardly extending projections or eyehooks 330, disposed upon a second, adjacent stress or seam plate 310, from entering the one or more openings or apertures 332 defined within first one of the stress or seam plates 310 and thereby become interlocked therewithin. Alternatively, one or more of the downwardly extending projections or eyehooks 330 of a first one of the stress or seam plates 310 may effectively be deformed so as to likewise prevent the one or more of the downwardly extending projections or eyehooks 330 of the first stress or seam plate 310 from entering the openings or apertures 332 defined within a second, adjacent stress or seam plate 310 so as not to thereby become interlocked therewithin.

Figure 11:
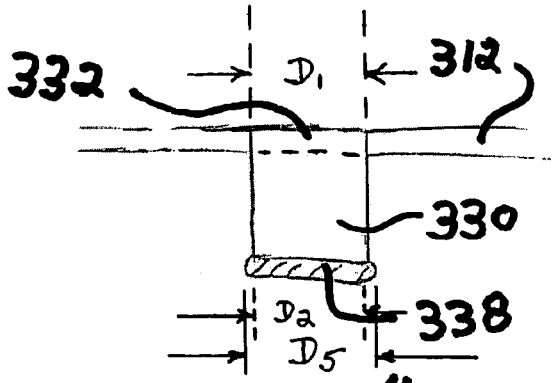
FIG. 11 is a cross-sectional view illustrating a first mode for deforming each one of the downwardly extending projections or eyehooks, as disclosed within FIGS. 6 and 7, so as to effectively prevent the undesirable interlocking of the downwardly extending projections or eyehooks of one of the stress or seam plates within the rectangularly configured apertures formed within an adjacent one of the stress or seam plates when a plurality of stress or seam plates are disposed within a stacked array.

Therefore, with reference now being made to FIG. 11, it is seen that in accordance with a first mode for deforming one or more of the downwardly extending projections or eyehooks 330, as disclosed within FIGS. 6 and 7, so as to effectively prevent the undesirable interlocking of the downwardly extending projections or eyehooks 330, disposed upon one of the stress or seam plates 310, within the rectangularly configured apertures 332, formed within an adjacent one of the stress or seam plates 310, when a plurality of stress or seam plates 310 are disposed within a stacked array, the apex portion 338 of each eyehook 330 is seen to have a substantially laterally flattened or widened cross-sectional configuration, as a result of having undergone a suitable peening or similar metal working process. Accordingly, it can be appreciated further that recalling the fact that the width of each opening or aperture 332 is characterized by means of a dimension $D_1$, and that the unaltered width of each eyehook 330 is characterized by means of a width dimension $D_2$ which is equal to that of each opening or aperture 332, then it is appreciated that the new width dimension $D_5$ of the apex portion 338, as a result of having undergone the aforenoted peening or other metal working process, is greater than the width dimension $D_1$ of the opening or aperture 332. Therefore, it is apparent that if the downwardly extending projection or eyehook 330, disposed upon a first one of the plurality of stress or seam plates 310 disposed within a stacked or nested array of stress or seam plates, attempts to enter a rectangularly configured aperture 332 formed within an adjacent one of the plurality of stress or seam plates 310 disposed within the stacked or nested array of stress or seam plates, such movement will effectively be prevented so as to, in turn, prevent the stress or seam plates 310 from becoming interlocked together.

Figure 12A:
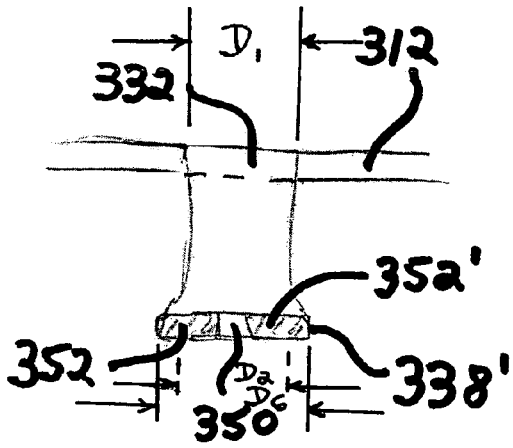
FIG. 12A is a cross-sectional view, similar to that of FIG. 11, illustrating, however, a second mode for deforming each one of the downwardly extending projections or eyehooks, as disclosed within FIGS. 6 and 7, so as to effectively prevent the undesirable interlocking of the downwardly extending projections or eyehooks of one of the stress or seam plates, within the rectangularly configured apertures formed within an adjacent one of the stress or seam plates, when a plurality of stress or seam plates are disposed within a stacked array.
Figure 12B:
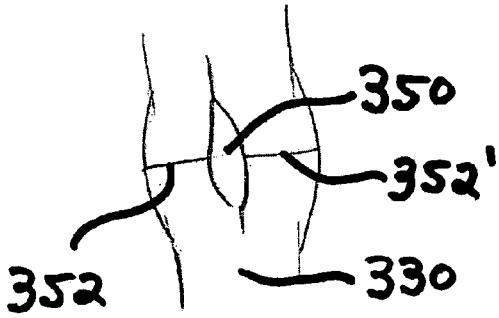
FIG. 12B is a bottom plan view of the deformed projection or eyehook as illustrated within FIG. 12A.

With reference now being made to FIGS. 12A and 12B, a second mode for deforming one or more of the downwardly extending projections or eyehooks 330, as disclosed within FIGS. 6 and 7, so as to effectively prevent the undesirable interlocking of the downwardly extending projections or eyehooks 330, disposed upon one of the stress or seam plates 310, within the rectangularly configured openings or apertures 332, formed within an adjacent one of the stress or seam plates 310, when a plurality of stress or seam plates 310 are disposed within a stacked or nested array, is disclosed. More particularly, as can be appreciated from FIGS. 12A and 12B, the apex portion 338' of each eyehook 330 is seen to have a substantially laterally flattened or widened cross-sectional configuration as a result of having undergone a suitable punching or similar metal piercing process whereby as a result of the formation of an punched or pierced region 350 with the central region of the apex portion 338', the laterally outward residual regions 352, 352' of the apex portion 338' are expanded laterally outwardly.

Therefore, it can again be appreciated that since the width of each opening or aperture 332 is characterized by means of a dimension $D_1$, and the unaltered width of each eyehook 330 is characterized by means of a width dimension $D_2$ which is equal to that of each opening or aperture 332, then it is appreciated that the new width dimension $D_6$ of the apex portion 338', as a result of having undergone the aforenoted punching or piercing process, is greater than the width dimension $D_1$ of the opening or aperture 332. Accordingly, it is apparent that if the downwardly extending projection or eyehook 330, disposed upon a first one of the plurality of seam or stress plates 310 disposed within a stacked or nested array of stress or seam plates, attempts to enter a rectangularly configured aperture 332 formed within an adjacent one of the plurality of stress or seam plates 310 disposed within the stacked or nested array of stress or seam plates, the attempted movement will effectively be prevented so as to, in turn, prevent the stress or seam plates 310 from becoming interlocked together.

Figure 13:
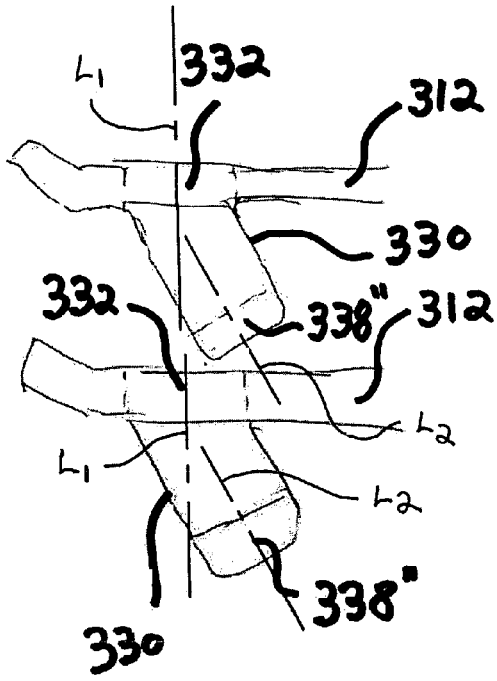
FIG. 13 is a cross-sectional view, similar to those of FIGS. 11 and 12A illustrating, however, a third mode for effectively deforming each one of the downwardly extending projections or eyehooks, as disclosed within FIGS. 6 and 7, so as to effectively prevent the undesirable interlocking of the downwardly extending projections or eyehooks of one of the stress or seam plates, within the rectangularly configured apertures formed within an adjacent one of the stress or seam plates, when a plurality of stress or seam plates are disposed within a stacked array as illustrated.

With reference now being made to FIG. 13, a third mode for effectively deforming one or more of the downwardly extending projections or eyehooks 330, as disclosed within FIGS. 6 and 7, so as to effectively prevent the undesirable interlocking of the downwardly extending projections or eyehooks 330, disposed upon one of the stress or seam plates 310, within the rectangularly configured apertures or openings 332, formed within an adjacent one of the stress or seam plates 310, when a plurality of stress or seam plates 310 are disposed within a stacked or nested array, is disclosed. More particularly, as can be appreciated from FIG. 13, each one of the apex portions 338" of each downwardly extending projection or eyehook 330 has effectively been deformed in that the central axis of the projection or eyehook 330 is disposed at a predetermined angle with respect to the central axis of the opening or aperture 332. Therefore, it can again be appreciated that since the apex portion 338" of a projection or eyehook 330 disposed upon a first upper one of a plurality of nested or stacked stress or seam plates 310 is skewed, inclined, and misaligned with respect to an opening or aperture 332 defined within a second lower one the plurality of nested or stacked stress or seam plates 310, then when the downwardly extending projection or eyehook 330, disposed upon the first one of the plurality of seam or stress plates 310, attempts to enter the rectangularly configured aperture 332 formed within the second lower one of the plurality of stress or seam plates 310, the attempted movement will effectively be prevented as a result of the apex portion 338" of the upper one of the stress or seam plates 310 encountering the edge or side wall portion of the disk 312, which partially defines the opening or aperture 332, so as to, in fact, prevent the stress or seam plates 310 from becoming interlocked together.

Figure 14:
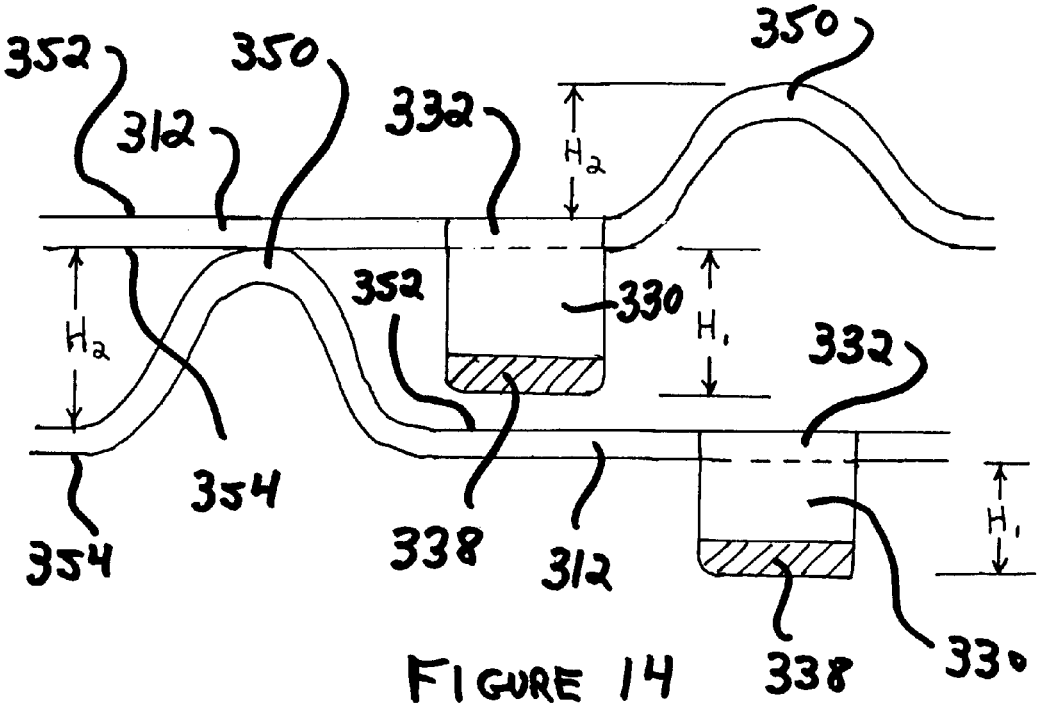
FIG. 14 is a partial cross-sectional view of a stress or seam plate illustrating the provision of upwardly extending bumps or dimples disposed upon an upper surface portion of each one of the stress or seam plates and having a depth dimension which is greater than the depth dimension of each one of the downwardly extending projections or eyehooks disposed upon the undersurface portion of each one of the stress or seam plates such that when a plurality of the stress or seam plates are disposed within a stacked array, the downwardly extending projections or eyehooks will be effectively prevented from engaging each other.

With reference lastly being made to FIG. 14, a last means or embodiment for effectively preventing the interlocking together of adjacent stress or seam plates, when a plurality of the stress or seam plates are disposed within a nested or stacked array, is disclosed. More particularly, in lieu of coining or swaging the rim portions of the stress or seam plate disk 312 disposed immediately adjacent to each opening or aperture 332 as disclosed, for example, within FIGS. 8A-8D, or in lieu of displacing the rim portions of the stress or seam plate 312 disposed immediately adjacent to each opening or aperture 332 in accordance with either one of the techniques disclosed within FIGS. 9,10A,10B, or still further, in lieu of deforming the apex portions of the projections or eyehooks 330 as disclosed within FIGS. 11, 12A,12B, or lastly, in lieu of providing the projections or eyehooks 330 with an angled inclination or misaligned orientation as disclosed within FIG. 13, the mode or technique disclosed within FIG. 14 comprises the provision of bumps or dimples 350 upon the upper surface portion 352 of each stress or seam plate disk 312. More specifically, the bumps or dimples 350 disposed upon the upper surface 352 of each stress or seam plate 310 extend or project upwardly from the upper surface portion 352 of the stress or seam plate disk 312 to such an extent that adjacent stress or seam plates 310, disposed within a stacked or nested array of stress or seam plate 310, are, for example, vertically spaced from each other a predetermined distance such that the downwardly extending projections or eyehooks 330, disposed upon a first upper one of the plurality of nested or stacked stress or seam plates 310, cannot in fact be positioned close enough to a second lower one of the plurality of nested or stacked stress or seam plates 310 so as to enter one of the openings or apertures 332 defined within the second lower one the plurality of nested or stacked stress or seam plates 310.

In particular, as illustrated within FIG. 14, it is seen, for example, that each downwardly extending projection or eyehook 330 has a depth dimension $H_1$, while each upwardly extending bump or dimple 350 has a depth dimension, as measured from the upper surface portion 352 of the stress or seam plate disk 312, $H_2$, wherein it is further noted that $H_2>H_1$. Therefore, when the plurality of stress or seam plates 310 are disposed within their stacked or nested array, the upwardly extending bumps or dimples 350, disposed upon a particular one of the nested or stacked stress or seam plates 310, will engage the undersurface portion 354 of the adjacent upper one of the stress or seam plates 310 such that the downwardly extending projections or eyehooks 330 of the upper one of the stress or seam plates 310 will be sufficiently spaced from the openings or apertures 332 defined within the lower one of the stress or seam plates 310 so as not to be capable of entering the same and becoming interlocked therewith.

Thus, it may be seen that in accordance with the principles and teachings of the present invention, a new and improved stress plate or seam plate has been developed wherein, by means of the various embodiments disclosed and described hereinbefore, the downwardly extending projections or eyehooks, disposed upon, for example, a first one of a plurality of stacked or nested stress or seam plates, will not be able to enter the openings or apertures defined within a second one of the plurality of stacked or nested stress or seam plates so as not to become interlocked therewith.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. A seam plate for securing a membrane sheet to an underlying substructure, comprising:

a plate having the form of a disk;

an aperture defined within a central portion of said disk for receiving a fastener for securing said plate to an underlying substructure;

a plurality of projections having first predetermined profile dimensions, formed from said disk as a result of material being partially severed from said disk, and extending downwardly from an undersurface portion of said disk for engaging a membrane sheet so as to effectively secure the membrane sheet to the underlying substructure when said disk is fixedly secured to the underlying substructure by the fastener;

a plurality of residual apertures, having second predetermined profile dimensions substantially matching said first predetermined profile dimensions of said plurality of projections, being defined within said disk at those locations at which the material, used to form said plurality of projections, was partially severed from said disk; and means for altering said second predetermined profile dimensions of said plurality of residual apertures such that a plurality of projections, which are disposed upon an other seam plate, which is similar to said seam plate, and which have profile dimensions corresponding to said first predetermined profile dimensions of said plurality of projections disposed upon said seam plate, cannot respectively enter, and become interlocked with, said plurality of residual apertures defined upon said seam plate.

2. The seam plate as set forth in claim 1, wherein:

said means for altering said second predetermined profiles of said plurality of residual apertures comprises coined rim regions disposed immediately adjacent to, and extending inwardly into, said plurality of residual apertures so as to partially occlude said plurality of residual apertures, thereby effectively reducing said second predetermined profile dimensions of said plurality of residual apertures.

3. The seam plate as set forth in claim 2, wherein:

said coined rim regions comprise coined undersurface portions of said plate disk.

4. The seam plate as set forth in claim 2, wherein:

said coined rim regions comprise coined upper surface portions of said plate disk.

5. The seam plate as set forth in claim 2, wherein:

said coined rim regions comprise coined upper surface and undersurface portions of said plate disk.

6. The seam plate as set forth in claim 2, wherein:

said coined rim regions comprise coined portions of said plate disk disposed upon opposite sides of said plurality of residual apertures.

7. The seam plate as set forth in claim 1, wherein:

said means for altering said second predetermined profile dimensions of said residual apertures comprises displaced material portions formed upon side portions of said plurality of residual apertures.

8. The seam plate as set forth in claim 1, wherein:

said means for altering said second predetermined profile dimensions of said residual apertures comprises punched rim regions disposed immediately adjacent to said plurality of residual apertures so as to cause material of said plate disk to expand into and partially occlude said plurality of residual apertures, thereby effectively reducing said second predetermined profile dimensions of said plurality of residual apertures.

9. A seam plate for securing a membrane sheet to an underlying substructure, comprising:

a plate having the form of a disk;

an aperture defined within a central portion of said disk for receiving a fastener for securing said plate to an underlying substructure;

a plurality of projections having first predetermined profile dimensions, formed from said disk as a result of material being partially severed from said disk, and extending downwardly from an undersurface portion of said disk for engaging a membrane sheet so as to effectively secure the membrane sheet to the underlying substructure when said disk is fixedly secured to the underlying substructure by the fastener;

a plurality of residual apertures, having second predetermined profile dimensions substantially matching said first predetermined profile dimensions of said plurality of projections, being defined within said disk at those locations at which the material, used to form said plurality of projections, was partially severed from said disk; and means for altering said first predetermined profile dimensions of said plurality of projections such that said plurality of projections, disposed upon said seam plate, cannot respectively enter, and become interlocked with, a plurality of residual apertures which are defined within an other seam plate, which is substantially similar to said seam plate, and which have profile dimensions corresponding to said second predetermined profile dimensions of said plurality of residual apertures defined within said seam plate.

10. The seam plate as set forth in claim 9, wherein:

said means for altering said first predetermined profile dimensions of said plurality of projections comprises the lateral expansion of dependent end portions of said plurality of projections such that said dependent end portions of said plurality of projections have predetermined profile dimensions which are greater than said first predetermined profile dimensions.

11. The seam plate as set forth in claim 10, wherein:

said dependent end portions of said plurality of projections are peened so as to cause said lateral expansion of said dependent end portions of said plurality of projections.

12. The seam plate as set forth in claim 10, wherein:

said dependent end portions of said plurality of projections are punched at central regions of said dependent end portions so as to cause said lateral expansion of said dependent end portions of said plurality of projections.

13. A seam plate for securing a membrane sheet to an underlying substructure, comprising:

a plate having the form of a disk;

an aperture defined within a central portion of said disk for receiving a fastener for securing said plate to an underlying substructure;

a plurality of projections having first predetermined profile and depth dimensions, formed from said disk as a result of material being partially severed from said disk, and extending downwardly from an undersurface portion of said disk for engaging a membrane sheet so as to effectively secure the membrane sheet to the underlying substructure when said disk is fixedly secured to the underlying substructure by the fastener;

a plurality of residual apertures, having second predetermined profile dimensions substantially matching said first predetermined profile dimensions of said plurality of projections, being defined within said disk at those locations at which the material, used to form said plurality of projections, was partially severed from said disk; and means, disposed upon, and extending upwardly from, upper surface portions of said disk and having second predetermined depth dimensions which are greater than said first predetermined depth dimensions of said plurality of projections, for spacing an undersurface portion of an other seam plate, which is similar to said seam plate, away from said seam plate to a predetermined degree such that a plurality of projections, disposed upon the other seam plate and having profile and depth dimensions which correspond to said first predetermined profile and depth dimensions of said plurality of projections disposed upon said seam plate, cannot respectively enter, and become interlocked with, said plurality of residual apertures defined within said seam plate.

14. The seam plate as set forth in claim 13, wherein:

said means, disposed upon, and extending upwardly from, said upper surface portions of said disk, and having second predetermined depth dimensions which are greater than said first predetermined depth dimensions of said plurality of projections disposed upon said disk, for spacing the undersurface portion of the other seam plate away from said seam plate to a predetermined degree, is selected from the group comprising bumps and dimples.

15. The seam plate as set forth in claim 13, wherein:

each one of said plurality of downwardly extending projections has a rounded engagement portion for engaging the membrane sheet so as to effectively secure the membrane sheet to the underlying substructure without piercing the membrane sheet so as not to cause tearing and rupture of the membrane sheet.

16. The seam plate as set forth in claim 15, wherein:

each one of said plurality of downwardly extending projections has a substantially V-shaped cross-sectional configuration, and said rounded engagement portion of said downwardly extending projection comprises a radiused apex portion of said substantially V-shaped projection.

17. The seam plate as set forth in claim 16, wherein:

each one of said substantially V-shaped projections comprises a pair of sides with an included angle defined at said apex portion of 90°.

18. The seam plate as set forth in claim 17, wherein:

each one of said substantially V-shaped projections is severed from said disk along longitudinally extending sides thereof and are integrally attached to said circular plate along longitudinally separated ends thereof.

19. A seam plate for securing a membrane sheet to an underlying substructure, comprising:

a plate having the form of a disk;

an aperture defined within a central portion of said disk for receiving a fastener for securing said plate to an underlying substructure;

a plurality of projections having first predetermined profile dimensions, formed from said disk as a result of material being partially severed from said disk, and extending downwardly from an undersurface portion of said disk for engaging a membrane sheet so as to effectively secure the membrane sheet to the underlying substructure when said disk is fixedly secured to the underlying substructure by the fastener;

a plurality of residual apertures, having second predetermined profile dimensions substantially matching said first predetermined profile dimensions of said plurality of projections, being defined within said disk at those locations at which the material, used to form said plurality of projections, was partially severed from said disk; and means defined upon said seam plate for preventing said plurality of projections, disposed upon said seam plate, from respectively entering and becoming interlocked with a plurality of residual apertures, which are defined within an other seam plate, which is similar to said seam plate, and which have profile dimensions corresponding to said second predetermined profile dimensions of said plurality of residual apertures defined within said seam plate, and for preventing a plurality of projections, which are disposed upon the other seam plate and which have profile dimensions corresponding to said first predetermined profile dimensions of said plurality of projections disposed upon said seam plate, from respectively entering and becoming interlocked with said plurality of residual apertures which are defined within said seam plate.

20. The seam plate as set forth in claim 19, wherein:

said means, defined upon said seam plate for preventing said plurality of projections, disposed upon said seam plate, from respectively entering and becoming interlocked with the plurality of residual apertures which are defined upon the other seam plate, and for preventing the plurality of projections, which are disposed upon the other seam plate, from respectively entering and becoming interlocked with said plurality of residual apertures which are defined within said seam plate, comprises means for altering either one of said first predetermined profile dimensions of said plurality of projections disposed upon said seam plate, and said second predetermined profile dimensions of said plurality of residual apertures defined within said seam plate.

21. The seam plate as set forth in claim 19, wherein:

said means, defined upon said seam plate for preventing said plurality of projections, disposed upon said seam plate, from respectively entering and becoming interlocked with the plurality of residual apertures which are defined upon the other seam plate, and for preventing the plurality of projections, which are disposed upon the other seam plate, from respectively entering and becoming interlocked with said plurality of residual apertures which are defined within said seam plate, comprises means, disposed upon and extending upwardly from upper surface portions of said disk, and having second predetermined depth dimensions which are greater than said first predetermined depth dimensions of said plurality of projections, for spacing an undersurface portion of the other seam plate away from said seam plate to a predetermined degree.

* * * * *